United States Patent [19]

Lohwasser et al.

[11] 4,035,884

[45] July 19, 1977

[54] PROCESS FOR THE PRODUCTION OF BULK YARNS

[75] Inventors: Hermann Lohwasser; Alfred Nogaj; Ulrich Reinehr, all of Dormagen, Germany

[73] Assignee: Bayer Aktiengesellschaft, Leverkusen, Germany

[21] Appl. No.: 569,931

[22] Filed: Apr. 21, 1975

[30] Foreign Application Priority Data

Apr. 27, 1974 Germany ..... 2420472

[51] Int. Cl.[2] ..... D02J 1/22

[52] U.S. Cl. ..... 28/281; 19/.46; 57/157 R

[58] Field of Search ..... 28/72.17, 72 HR; 19/.3, 19/.32, .35, .37, .39, .41, .46, .56; 57/157 R, 157 MS

[56] References Cited

U.S. PATENT DOCUMENTS

| | | | |
|---|---|---|---|
| 2,746,091 | 6/1956 | Tissot et al. | 19/.41 |
| 2,920,176 | 1/1960 | Jorgensen | 19/.37 |
| 3,279,163 | 10/1966 | Lulay | 28/72.17 X |
| 3,429,017 | 2/1969 | Holfeld et al. | 28/72.17 |
| 3,438,192 | 4/1969 | Ryan | 28/72.17 X |
| 3,696,467 | 10/1972 | Lohrke | 19/.37 |

*Primary Examiner*—Louis K. Rimrodt
*Attorney, Agent, or Firm*—Plumley and Tyner

[57] ABSTRACT

The invention relates to a process for the production of bulk yarns from chemically different acrylonitrile polymers.

8 Claims, No Drawings

PROCESS FOR THE PRODUCTION OF BULK YARNS

Synthetic fibers of acrylonitrile polymers are widely used because they embody a number of outstanding properties, one of the more important of which is their wool-like character. Various methods of producing yarn have been adopted with a view to providing textile articles of these fibres with the bulk and feel of wool. For example, if shrinkable and fully shrunk staple fibres are spun together and the yarn is subjected to a shrinkage-initiating treatment by dyeing or steaming, the yarn "bulks up" through shrinkage of the shrinkable staple fibre and acquires a bulky, wool-like feel. Another commercially important possibility is the breaking (conversion by breaking) of tows, in which a tow is broken into slivers of shrinkable fibres which, if desired, may be converted into non-shrinkable fibres by steaming. In conversion by breaking, for example using machines of the Turbostapler, Seydel, Tematex or Duranitre type (tow to top processing), it is known that the machine used can be adapted to the particular type of tow to produce slivers with boiling-induced shrinkages of from about 8 to 28%. Under these circumstances, any processor is able to produce his own bulk yarn by suitably selecting the degree of shrinkage and the proportion of shrinkable fibres in the mixture as a whole. It is preferred to produce so-called high-bulk yarns which, in the form of untreated yarns, have a boiling-induced shrinkage of about 19 to 22% and contain from 40 to 45% by weight of shrinkable fibres and from 60 to 55% by weight of fully shrunk fibres.

In the process of conversion by breaking described above, it is necessary first of all to produce a shrinkable sliver from which part is removed for conversion into fully shrunk fibres. Accordingly, the production of a non-shrinkable fibre with the fibre length distribution typical of conversion by breaking from an originally fully shrunk tow, followed by reunion with the shrinkable fibre, is a necessary extra step in the production of bulk yarn. In addition, the separate handling of both slivers on a production scale necessitates precautions against confusion and for maintaining weight ratio in the mixture of slivers.

Accordingly, a search was started for possibilities of producing bulk yarns by breaking tows of acrylonitrile fibres in machines of the kind referred to above without any need for the steps of steaming and combining component slivers, i.e. for a direct process with the production sequence:—breaking —drawing —spinning —dyeing or steaming. It was found that the difference in the shrinkage behaviour of two chemically different acrylonitrile filaments in tow form could be utilised by processing tows of this kind under the same tearing conditions. The tow may either consist of a mixture of filaments or may be processed in the form of two chemically different tows. By virtue of the difference in shrinkage of their constituent fibres, slivers of tow mixtures or mixed tows of this kind may be directly shrunk and bulked without any need for further intermediate steps, thereby leading the way to a wide range of new bulk yarns.

Accordingly, the invention relates to a process for the production of bulk yarns of chemically different acrylonitrile polymers by breaking tows in conventional breaking machines, spinning the resulting slivers and shrinking the yarns thus obtained, distinguished by the fact that there is no steaming step between breaking and spinning.

It is possible to use a single tow consisting of chemically different filaments or, alternatively, two or more chemically different tows.

The process according to the invention may be carried out with almost any kind of filament-forming acrylonitrile copolymer of which at least 85% by weight consists of acrylonitrile and the rest of one or more comonomers copolymerisable with acrylonitrile, such as for example methyl acrylate, methyl methacrylate, vinyl acetate, isobutene-1,3-diacetate, acrylamide, methacrylonitrile, styrene, vinyl chloride, N,N-dimethylaminoethyl methacrylate, styrene sulphonic acid, methallyl sulphonic acid, etc. Copolymers of acrylonitrile with ester monomers and acid dye additives are preferably used. Referring in particular to the group of copolymers of acrylonitrile, methyl acrylate and sodium methallyl sulphonate or m-methacrylamino benzene-benzene disulphonimide, it is possible to use pairs of products which differ in their content of acrylic acid methyl ester or dye additive or ester plus additive. According to the invention, polymers of which at least 85% by weight consist of acrylonitrile, up to 10% by weight of ester component and up to 5% by weight of acidic comonomers, are preferably used.

It is particularly preferred to use methyl acrylate as the ester component. Particularly preferred dye additives are methallyl sulphonic acid, m-methacrylamino benzene-benzene disulphonimide and their salts.

The polymers are individually dry spun from conventional non-aqueous solutions, for example in dimethyl formamide or dimethyl sulphoxide, to form filaments which are then further processed either individually or in combination to form tows with individual fibre deniers of from 2.4 to 5.5 dtex. Stretching ratios in the range of from 1 : 3.0 to 1: 5.0 (i.e. threefold to fivefold) are advantageously applied during production of the tow. The chemical nature of the particular polymers selected for the purposes of the invention will determine the character assumed by the bulked and dyed, i.e. fully shrunk, textile yarn. The difference in chemical composition influences dyeability, lustre, bulk, elasticity, feel, etc. It is possible by suitably selecting the components to obtain a more slender and clear, a more open and hairy or a more voluminous and mossy yarn. Thus, the process according to the invention opens the way to a wide variety of new bulk yarns. The more slender medium-bulk yarns are of particular interest for use in the field of fine-knitted goods.

The tows used in the process according to the invention are produced from commercially readily available acrylonitrile polymers. Promising product combinations may be assessed by preliminary tests with the individual products. To this end, an acrylonitrile polymer is, for example, dry spun into filaments from a solution in dimethyl formamide. The filament yarn is stretched in a ratio of 1 : 3.6 in boiling water, continuously passed under tension through a dryer and the stretched yarn cooled under tension. The boiling-induced shrinkage subsequently measured is a reference point for the degree of shrinkage to be expected after conversion by breaking.

It has now been found that the boiling-induced shrinkage which stretched yarns of this kind undergo increases with increasing comonomer content in the acrylonitrile polymer, so that a difference in the comonomer content may be utilised to obtain a difference in the degree of shrinkage, because it has also been found that, for example, the boiling-induced shrinkage of fibres of so-called Turbo slivers also tends to increase with increasing comonomer content under uniform production conditions. Accordingly, a bulk effect can be expected in mixed yarns where two distinctly different chemical compositions are selected for their shrinkable constituents.

It is possible to obtain a narrower selection of the constituents.

It is possible to obtain a narrower selection of the products, for example by initially subjecting tows based on different polymers to conversion by breaking on their own under the same test conditions. The boiling-induced shrinkage in twisted yarn form is then determined from the shrinkable slivers thus obtained.

The preferred product pairs made up from filament yarns of this kind are those with a difference in the individual yarn shrinkage level of from about 7 to 15%.

If, finally, mixed pairs of these slivers are produced, a survey of the bulking properties of the mixed yarns can be obtained immediately after spinning and shrinkage.

It is known among experts that, in the case of an acrylic tow, breaking can be made to produce very different results in regard to boiling-induced fibre-shrinkage, denier, strength elongation, length distribution etc., depending upon the setting of the breaking machine (stretching ratio, heating temperature, speed, etc.). Naturally this also applies to tows in which the acrylic filaments have special chemical compositions, so that the particular setting of the breaking machine is an important factor in the commercial viability of breaking tows differing in their chemical composition. In addition, it is generally known that the bulking character of bulk yarns can be influenced through the mixing ratio of their constituent fibres. For example, it is possible by varying the mixing ratio to convert a high-bulk yarn into a low-bulk yarn by passing the intermediate medium-bulk stage. Accordingly, the choice of the production conditions for the process according to the invention is virtually impossible to define in terms of figures so that, on the basis of the concept behind the invention, it will be possible to find other useful tows and compositions in addition to the examples given hereinafter without departing from the scope of the invention.

In addition to utilising tows of different chemical composition, the process according to the invention is further characterised by the production of slivers which can be bulked directly, i.e. without having first to be subjected to a steaming operation. As already mentioned, the material to be converted may be presented in such a way that the breaking machine receives, adjacent to one another, a tow of chemical type A and hence of predetermined shrinkage behaviour and a tow of chemical type B with different shrinkage level. The weights of the two tows then determine the mixing ratio of A : B in the sliver produced by breaking.

From the point of view of uniformity of processing, it is desirable to predetermine the subsequent mixing ratio between types A and B within a tow so that it is also possible to obtain greater latitude in regard to the overall weight and rate of travel of the sliver and hence in regard to machine output. To this end, the mixture of filaments in the tow can be produced during the original spinning process (for example by alternating spinnerets for types A and B) or during the aftertreatment of the spun material (for example by doubling slivers of types A and B). The preferred range for the A : B mixing ratio is from 33 : 67 to 67 : 33 by weight.

The binary mixture or mixed tow is then uniformly further processed in known manner in the machines described earlier on by stretching between heated plates in a preferred stretching ratio of from 1 : 1.20 to 1 : 1.60, stretch-breaking and crimping.

The slivers based on fibres differing in their degree of shrinkage are passed through the usual stretching and preparatory spinning stages and the roving spun. Accordingly, tows of the kind in question are converted by breaking at an optimum setting of the breaking machine, in addition to which none of the fibre mass need be separated, and then specially treated and re-incorporated to produce the difference in shrinkage from fibre to fibre, as in the conventional bulk-yarn process.

The application of the invention is illustrated in the following with reference to a few examples of bulk yarn production. The invention is by no means limited to the product combinations and test conditions employed in these examples of bulk yarn production, so that special modifications or refinements do not fall outside the scope of the invention.

Selection of polymers for the purposes of the invention

Polymers of acrylonitrile were produced by continuous redox polymerisation using the catalyst system $K_2S_2O_8/Na_2S_2O_5$ for the acid modified types and the catalyst system $H_2O_2/HOCH_2CH_2SH$ for the basic products, together with the comonomers mentioned in Table I.

The polymers, or mixtures thereof, were dissolved in dimethyl formamide and the filtered spinning solutions were dry spun through spinnerets with 180 bores 0.20 mm in diameter into a spinning cell 580 cm long (take-off rate 250 meters per minute, cell temperature approximately 170° to 180° C). The filament yarns with an overall denier of approximately 5700 detex were then stretched under uniform conditions in boiling water in a ratio of 1 : 3.6, passed under tension through a drying cabinet with an air temperature of approximately 130° C and wound into packages. The boiling-induced shrinkage of the stretched yarns was determined after cooling and drying in air. As shown in Table I, boiling-induced shrinkage increases with increasing comonomer content.

Table I

| Yarn number | Composition in % by weight of comonomer | boiling-induced shrinkage (%) |
|---|---|---|
| 1 | 93.6 acrylonitrile, 5.7 methyl acrylate, 0.4 Additive S*, 0.3 Additive M** | 10.4 |
| 2 | 93.7 acrylonitrile, 5.7 methyl acrylate, 0.6 Additive M**, | 9.1 |
| 3 | 93.4 acrylonitrile, 5.6 methyl acrylate, 1.0 Additive S*, | 10.6 |
| 4 | 93.4 acrylonitrile, 6.0 methyl acrylate, 0.6 sodium styrene sulphonate | 9.8 |
| 5 | 93.0 acrylonitrile, 7.0 Additive S | 12.6 |
| 6 | 99.4 acrylonitrile, 0.6 Addtive M | 6.1 |
| 7 | 96.0 acrylonitrile, 3.0 methyl acrylate, 1.0 Additive S | 6.7 |
| 8 | 100 acrylonitrile | 3.5 |
| 9 | 89.2 acrylonitrile, 9.8 methyl acrylate, 1.0 Additive S | 16.7 |
| 10 | 91.2 acrylonitrile, 5.4 methylacrylate, 3.4 Additive M | 14.5 |

Table I-continued

| Yarn number | Composition in % by weight of comonomer | boiling-induced shrinkage (%) |
|---|---|---|
| 11 | 91.5 acrylonitrile, (of 55 parts of No. 3 + 45 parts of No. 9)*** | 14.8 |
| 12 | 98.7 acrylonitrile, (of 15 parts of No. 10 + 85 parts of No. 8)*** | 7.0 |
| 13 | 91.0 acrylonitrile, 5.0 methyl acrylate, 4.0 N,N-dimethylaminoethyl methacrylate | 17.2 |
| 14 | 90.5 acrylonitrile, 1.0 Additive M, 8.5 isobutene-1,3-diacetate | 18.0 |
| 15 | 91.6 acrylonitrile, 1.0 Additive M, 7.4 2-ethylhexyl acrylate | 12.5 |

*Additive S = methacrylamino benzene-benzene disulphimide
**Additive M = sodium methallyl sulphonate
***calculated gross value Composition of tows for the purposes of the invention In general, tows with a ribbon weight of approximately 27 g/m were continuously produced from the particular dry-spun material by wet-stretching and drying accompanied by shrinkage. Breaking was carried out in a Turbostapler with two ribbons at the heating-plate drafts and temperatures quoted in Table II.

The mechanically crimped Turbo slivers were passed through two stretching and four preparatory spinning stages and spun into single yarns of denier 250 dtex. The shrinkage of these yarns was measured after boiling for 30 minutes at 97 to 98° C, followed by drying at room temperature.

Table II shows that, for a given setting of the breaking machine, increased boiling-induced yarn shrinkage levels are found in tows with a low acrylonitrile content based on the polymer or polymer mixture.

Table II

| Yarn number | Polymer composition in % by weight (for Add. S and Add. M, cf. Table I) |
|---|---|
| 16 | 93.5 acrylonitrile, 5.8 methyl acrylate, 0.4 Additive S, 0.3 Additive M |
| 17 | same as No. 16 |
| 18 | 89,45 acrylonitrile, 9.8 methyl acrylate, 0.45 Additive S, 0.3 Additive M |
| 19 | same as No. 18 |
| 20 | 89.8 acrylonitrile, 9.25 methyl acrylate, 0.95 Additive S |
| 21 | 100 acrylonitrile |
| 22 | Of 80 parts of No. 21 and 20 parts of No. 37 |
| 23 | same as No. 22 |
| 24 | Of 70 parts of No. 21 and 30 parts of No. 37 |
| 25 | Of 60 parts of No. 21 and 40 parts of the composition 91.0 acrylonitrile, 5.2 methyl acrylate, 2.8 Additive M, 1.0 Additive S |
| 26 | 94.0 acrylonitrile, 5.0 isobutene-1,3-diacetate, 1.0 Additive M |
| 27 | 96.0 acrylonitrile, 3.0 methyl acrylate, 1.0 Additive M |
| 28 | 95.5 acrylonitrile, 3.05 methyl acrylate, 1.45 Additive M |
| 29 | same as No. 28 |
| 30 | same as No. 26 |
| 31 | 94.9 acrylonitrile, 4.1 methyl acrylate, 1.0 Additive S |
| 32 | same as No. 31 |
| 33 | Of 60 parts of No. 20 and 40 parts of No. 21 |
| 34 | same as No. 33 |
| 35 | 90.4 acrylonitrile, 5.6 methyl acrylate, 4.0 N,N-dimethylaminoethyl methacrylate |
| 36 | Of 50 parts of No. 16 and 50 parts of No. 37 |
| 37 | 91.2 acrylonitrile, 5.4 methyl acrylate, 3.4 Additive M |
| 38 | same as No. 37 |
| 39 | 93.0 acrylonitrile, 7.0 Additive S |
| 40 | Of 90 parts of 90.4 acrylonitrile, 8.9 methyl acrylate, 0.7 Additive M and 10 parts of 91.0 acrylonitrile, 5.2 methyl acrylate, 2.8 Additive M, 1.0 Additive S |

| Yarn number | Stretching (-fold) | Denier (dtex) | Heating plate draft (%) | Heating plate temperature (° C) | Boiling-induced yarn shrinkage (%) |
|---|---|---|---|---|---|
| 16 | 3.6 | 3.4 | 58 | 132 | 24.6 |
| 17 | 3.6 | 3.4 | 31 | 177 | 17.8 |
| 18 | 4.5 | 3.6 | 58 | 132 | 32.9 |
| 19 | 4.5 | 3.6 | 31 | 132 | 27.4 |
| 20 | 3.6 | 3.1 | 58 | 132 | 32.4 |
| 21 | 3.7 | 4.5 | 58 | 132 | 16.5 |
| 22 | 4.6 | 2.9 | 58 | 132 | 18.4 |
| 23 | 3.6 | 3.6 | 58 | 132 | 22.7 |
| 24 | 4.6 | 2.4 | 31 | 132 | 19.4 |
| 25 | 3.6 | 3.4 | 58 | 132 | 24.6 |
| 26 | 4.6 | 3.0 | 31 | 132 | 23.6 |
| 27 | 4.6 | 3.1 | 31 | 132 | 20.1 |
| 28 | 3.6 | 3.3 | 58 | 132 | 23.7 |
| 29 | 3.6 | 3.3 | 58 | 177 | 18.4 |
| 30 | 4.0 | 3.5 | 58 | 132 | 22.1 |
| 31 | 3.6 | 3.8 | 58 | 132 | 24.1 |
| 32 | 3.6 | 3.8 | 58 | 177 | 19.1 |
| 33 | 3.6 | 3.5 | 58 | 132 | 30.6 |
| 34 | 3.6 | 3.5 | 58 | 177 | 22.6 |
| 35 | 3.6 | 3.3 | 58 | 171 | 30.0 |
| 36 | 3.6 | 3.4 | 31 | 132 | 25.6 |
| 37 | 3.6 | 3.2 | 31 | 132 | 27.0 |
| 38 | 3.8 | 4.3 | 58 | 149 | 26.0 |
| 39 | 3.6 | 3.7 | 58 | 132 | 28.7 |
| 40 | 3.6 | 3.6 | 58 | 177 | 30.6 |

COMPARISON EXAMPLE

A tow with the same polymer composition as yarn No. 16 in Table II with a 0.5% by weight addition of delustrant, based on the polymer, was produced by continuous wet-stretching in a ratio of 1 : 3.6, drying with 20% shrinkage at 165° C and mechanical compression crimping with a ribbon weight of 54 g/m for an average individual denier of 3.4 dtex. A Turbo sliver was then produced in a Turbostapler with a single ribbon feed, a 58% heating zone draft and a heating plate temperature of 132° C. Part of the Turbo sliver thus produced was removed and steamed under pressure at 110° C. The shrinkable and fully shrunk Turbo slivers were then mixed in a ratio of 40 : 60 and spun into a 250 dtex single yarn with 475 Z-twists per meter. The untreated yarn had a boiling-induced shrinkage of 25.0%. The shrunk and bulked yarn had a strength of 5.9 cN/tex and an elongation at break of 15.2 %.

After dyeing, the yarn had a typical high-bulk character (HB-type), whilst a piece of R/R knitting produced from it on a flat-bed knitting machine had a smooth, mossy surface and a firm, bulky feel.

EXAMPLE 1

A tow with the same chemical composition as yarn No. 37 in Table II, a ribbon weight of 25.2 g/m, a denier of 4.3 dtex and a residual boiling-induced shrinkage of 2.7% after 3.8-fold stretching and continuous drying with shrinkage at 150° C, and a similarly produced tow with the same chemical composition as yarn No. 2 in Table I, a ribbon weight of 30.0 g/m, an individual denier of 3.3 dtex and a residual shrinkage of 3.5%, were processed together in a Type 633 Seydel breaking machine with a heating plate draft of 10% and a heating zone temperature of 100° C.

A yarn with a boiling-induced shrinkage of 20.9% was produced from the sliver in accordance with the invention, i.e. without steaming.

The dyed yarn was more slender and smoother than the yarn of the comparison Example, and the knitted article produced from it was smoother with a clear stitch pattern.

EXAMPLE 2

A mixed spun yarn, of which 67 parts had the same chemical composition as yarn No. 9 in Table I and 33 parts the same chemical composition as yarn No. 8 in Table I, was produced in a dry-spinning machine by simultaneously supplying two thirds of the spinning stations with a solution of type 9 and one third with a solution of type 8, and running off the spun filaments combined with one another in the form of a ribbon. Wet stretching in a ratio of 1 : 3.6 and drying at 124° C, accompanied by 15% shrinkage, produced a tow with a ribbon weight of 25.0 g/m, an individual denier of 3.8 dtex and a residual shrinkage of 8.5%.

A yarn with a boiling-induced shrinkage of 26.5% was obtained by processing two tows in a Turbostapler with a heating zone draft of 58% and a heating plate temperature of 177° C, followed by direct spinning in accordance with the invention.

After blank dyeing, this yarn was extremely bulky and the knitted article produced from it was fluffy-soft with an indistinct stitch pattern.

EXAMPLE 3

Dry-spun material was separately produced from a polymer with the same chemical composition as yarn No. 1 in Table I and a polymer with the same chemical composition as yarn No. 9 in Table I. A mixed spun material was made up from 60% of type 1 and 40% of type 9, and was processed into a tow with a ribbon weight of 29.4 g/m by wet stretching with a stretching ratio of 1 : 3.6 and drying at 130° C, accompanied by 21% shrinkage. The residual boiling-induced shrinkage amounted to 3.2% and the average individual denier to 3.7 dtex.

Two of these tows were broken in a Turbostapler with a 58% heating-zone draft and a heating plate temperature of 132° C, and directly processed into yarn. The boiling-induced shrinkage of the yarn amounted to 34.9%. The fully shrunk yarn had a tensile strength of 11.0 cN/tex and an elongation at break of 25.1%.

After dyeing and knitting, a material with a soapy-smooth feel, average bulk and a clearer stitch pattern than the comparison material was obtained.

EXAMPLE 4

Following the procedure of Example 3, a mixed spun material of the same composition was produced and processed into a tow with a ribbon weight of 25.3 g/m. The stretching ratio applied was 1 : 5.0, whilst drying was again carried out at 130° C. accompanied by 21% shrinkage.

Two of these tows with an individual denier of 3.0 dtex and a residual boiling-induced shrinkage of 6.3% were broken in a Type 633 Seydel breaking machine with a heating zone draft of 20% and a heating plate temperature of 132° C, and spun into yarn. The yarn had a boiling-induced shrinkage of 32.9% and, after shrinkage, a tensile strength of 14.1 cN/tex and an elongation at break of 25.8%. After it had been knitted up, the dyed material strongly resembled the material of Example 3.

EXAMPLE 5

Dry spun material was produced by separate spinning from a polymer with the same composition as yarn No. 1 in Table I and a polymer mixture with the same composition as yarn No. 24 in Table II. 40% of No. 1 was then combined with 60% of No. 24, followed by processing in accordance with Example 3 into a tow with a ribbon weight of 29.7 g/m for an average individual denier of 3.8 dtex.

Two of these tows were processed in a Turbostapler with a heating-zone draft of 58% and a heating plate temperature of 132° C, and were spun into yarn. The yarn had a boiling-induced shrinkage of 26.7%. The fully shrunk yarn had a tensile strength of 13.4 cN/tex and an elongation at break of 22.9%.

The dyed yarn was slender and smooth and the piece of knitted article produced from it was of medium bulk, soft feel and clearer stitch than reference piece.

EXAMPLE 6

Following the procedure of Example 5, a spun material mixture with the same composition was produced and aftertreated in the same way as in Example 4, giving a tow with a ribbon weight of 22.3 g/m, an individual denier of 3.1 dtex and a residual boiling-induced shrinkage of 1.7%.

Two of these tows were broken in a type 633 Seydel breaking machine with a heating plate draft of 20% and a heating zone temperature of 132° C, and were processed into yarn. The yarn had a boiling-induced shrinkage of 22.9%. After shrinkage, the yarn had a tensile strength of 16.2 cN/tex and an elongation at break of 21.7%. The dyed and knitted yarn produced a textile material with a flat bulk, clean stitch pattern and very soft feel.

EXAMPLE 7

A tow with a ribbon weight of 29.0 g/m, an individual denier of 3.6 dtex and a residual boiling-induced shrinkage of 3.1%, was obtained by aftertreatment in accordance with Example 3 from 60% of a dry-spun material with the following polymer composition: 95.7 acrylonitrile, 3.3 methyl acrylate, 1.0 Additive M and 40% of dry spun material with the same composition as yarn No. 16 in Table II.

The tow thus produced was broken in a Turbostapler (two-ribbon feed) with a heating zone draft of 31% and a heating plate temperature of 132° C, and the Turbo sliver thus produced was processed into single yarn. For a boiling-induced shrinkage of 22.7%, the yarn had a tensile strength of 11.3 cN/tex and an elongation at break of 20.5%. The dyed yarn was slender and smooth, whilst the knitted article produced from it was low in bulk and had a very soft feel.

EXAMPLE 8

The same tow as in Example 7, was subjected to a 58% draft at 132° C in a Turbostapler, broken and further processed in accordance with the invention. Thereafter the yarn had a boiling-induced shrinkage of 26.0%.

The dyed and knitted yarn produced a flat-bulk, soft and smooth textile material.

EXAMPLE 9

Following the procedure of Example 7, a mixed spun material with the same composition was produced and processed into a tow in the same way as in Example 4. The ribbon weight amounted to 24.0 g/m, the individual denier to 3.0 dtex and the residual boiling-induced shrinkage to 4.0%.

Breaking was carried out with two tows in a Type 633 Seydel breaking machine with a heating plate draft of 20% and a heating plate temperature of 132° C. The directly processed silver had a boiling-induced yarn shrinkage of 22.0%. After shrinkage, the yarn had a tensile strength of 15.7 cN/tex and an elongation at break of 20.8%. A knitted article produced from the dyed yarn had a soft feel, average bulk and a much clearer stitch pattern than a reference piece.

EXAMPLE 10

A tow with a ribbon weight of 28.8 g/m, an individual denier of 3.4 dtex and a residual boiling-induced shrinkage of 4.3%, was produced in accordance with Example 7 from 60% of a dry spun material with the same chemical composition as yarn No. 1 in Table I, and 40% with the following composition: 91.4% acrylonitrile, 5.5% methyl acrylate, 3.1% Additive M. The tow thus produced was processed in a Turbostapler with the same setting as in Example 7. The yarn produced from the Turbo sliver had a boiling-induced shrinkage of 25.6% and, after shrinkage, a tensile strength of 10.4 cN/tex and an elongation at break of 21.8%. Dyeing produced a bulky, pearly-looking yarn. The knitted article produced from that yarn had as smooth a surface as a reference piece.

EXAMPLE 11

Following the procedure of Example 10, a mixed spun material with the same composition was produced, aftertreated in the same way as in Example 4 and the tow was subjected to breaking.

The ribbon weight amounted to 25.0 g/m, the average individual denier to 3.0 dtex and the residual boiling-induced shrinkage of the tow to 5.2%. The yarn produced from the tow had a boiling-induced shrinkage of 26.7%. After shrinkage, the yarn had a tensile strength of 16.1 cN/tex and an elongation at break of 23.4%. Hank-dyeing produced a yarn of slightly crimped character from which a piece of knitting of good bulk with a far less indistinct surface than the reference piece was produced.

EXAMPLE 12

A tow with the same chemical composition as yarn No. 2 in Table I and a ribbon weight of 27.9 g/m, and a tow with the same composition as yarn No. 35 in Table II and a ribbon weight of 27.4 g/m, were delivered together to a Turbostapler and broken with a heating-plate draft of 58% and a heating plate temperature of 177° C. The mechanically crimped Turbo sliver was directly processed into yarn in accordance with the invention.

Dyeing-induced shrinkage amounted to 30.5%. A knitted article with a firm, woolly feel and a smooth surface was produced from the voluminous yarn.

What we claim is:

1. In a process for the production of bulk yarns from acrylonitrile polymers by breaking tows on a conventional breaking machine, spinning the slivers thus obtained and shrinking the yarns obtained therefrom, the improvement which comprises heat drafting tows consisting of a single tow consisting of chemically different filaments or at least two chemically different tows together and thereafter passing the heated tow or tows to a breaking machine.

2. The process of claim 1, wherein at least two chemically different tows are processed together.

3. The process of claim 2, wherein said chemically different tows consist of copolymers of acrylonitrile with at least one ethylenically unsaturated ester and at least one copolymerisable comonomer containing acidic groups, whose differences in acrylonitrile content amount to between 2 and 10% by weight.

4. The process of claim 3, wherein said acrylonitrile polymers contain at least 85% by weight of acrylonitrile, up to 10% by weight of at least one ethylenically unsaturated ester and up to 5% by weight of at least one copolymerisable comonomer containing acidic groups.

5. The process of claim 4, wherein said ethylenically unsaturated ester is selected from the group consisting of lower acrylic ester and vinyl ester and said comonomer containing acidic groups contain as the acidic group at least one member of the group consisting of a sulphonic acid group and a disulphonimide group.

6. The process of claim 1, wherein said chemically different filaments consist of copolymers of acrylonitrile with at least one ethylenically unsaturated ester and at least one copolymerisable comonomer containing acidic groups, whose differences in acrylonitrile content amount to between 2 to 10% by weight.

7. The process of claim 6 wherein said acrylonitrile polymers contain at least 85% by weight of acrylonitrile, up to 10% by weight of at least one ethylenically unsaturated ester and up to 5% by weight of at least one copolymerisable comonomer containing acidic groups.

8. The process of claim 7, wherein said ethylenically unsaturated ester is selected from the group consisting of lower acrylic ester and vinyl ester and said comonomer containing acidic groups contain as the acidic group at least one member of the group consisting of a sulphonic acid group and a disulphonimide group.

* * * * *